United States Patent [19]

Gasser

[11] 4,324,222

[45] Apr. 13, 1982

[54] VIBRATION DAMPENED FOR ARCHERY BOW

[76] Inventor: Max Gasser, Neugasse 35, 9442 Berneck, Switzerland

[21] Appl. No.: 60,133

[22] Filed: Jul. 24, 1979

[30] Foreign Application Priority Data

Mar. 28, 1979 [CH] Switzerland ..... 2853/79

[51] Int. Cl.[3] ..... F41B 5/00

[52] U.S. Cl. ..... 124/89

[58] Field of Search ..... 124/89, 23 R, 24 R, 124/88, 18, 41 A

[56] References Cited

U.S. PATENT DOCUMENTS 2,995,130 8/1961 Hoyt .
3,196,860 7/1965 Hoyt .
3,412,725 11/1968 Hoyt .
3,524,441 8/1970 Jeffery ..... 124/89 X
3,589,350 6/1971 Hoyt .
3,628,520 12/1971 Izuta ..... 124/89
3,814,075 6/1974 Hoyt .

*Primary Examiner*—Richard T. Stouffer
*Assistant Examiner*—William R. Browne
*Attorney, Agent, or Firm*—John J. Dennemeyer

[57] ABSTRACT

A mono-stabilizer for sport bows having a sleeve 5 is mounted on one end of a tube 7 and is provided with a screw bolt. On the other end of the tube 7 a terminal piece 8 is mounted which is provided with a self-cutting threading 9. This arrangement constitutes a mono-stabilizer which is resistant to breaking and vibration and provides a maximum damping of vibration. The sleeve has longitudinal grooves in the surface thereof. The sleeve includes structure for preventing rotation relative to the sleeve and for securing the proximal end of the elongated member to a bow.

7 Claims, 2 Drawing Figures

VIBRATION DAMPENED FOR ARCHERY BOW

BACKGROUND OF THE INVENTION

The invention relates to a mono-stabilizer for sport bows.

When shooting off arrows, the string of the bow always carries out a fading away oscillation. This oscillation transmits itself to the other parts of the bow and causes thereby an unsteady release of the arrow. This in turn reduces the aiming accuracy.

In a purely empiric way it has been tried successfully to dampen the annoying oscillations by applying stabilizers on the stock of the bow. A distinction must be made between two main groups, the mono-stabilizers and the twin-stabilizers. Mono-stabilizers are located in the plane formed by the string and the bow and are disposed above the stock, while twin-stabilizers are as a rule disposed symmetrically to this plane and behind the stock. The known constructions have raised and beaded portions as connection elements, which present themselves as notches. Therefore material fatigues appear at these points which reveal themselves in the form of breaks and loose parts.

SUMMARY OF THE INVENTION

The object of the invention is to decrease the breaking tendency and to reach a maximum damping.

According to the invention this is obtained in that the end adjacent the stock has a sleeve part which is pressed over a tube and which is provided with a screw bolt, and in that the end away from the stock has a terminal part provided with a self-cutting threading hole.

The screw bolt may be provided with a threading safety for preventing rotation with respect to the sleeve.

The tube may be conical and formed of a plastic or a light-metal material. Preferably the jacket surface of the sleeve part has longitudinal grooves.

The end of the tube away from the stock may be provided prior to the threading with a start head, which corresponds to the nominal diameter of the threading hole.

The terminal part may also have a second threading hole.

BRIEF DESCRIPTION OF THE DRAWINGS

The invention will be described more specifically hereafter, by means of an embodiment illustrated in the accompanying drawings, in which.

DETAILED DESCRIPTION OF PREFERRED EMBODIMENTS

Figure 2:
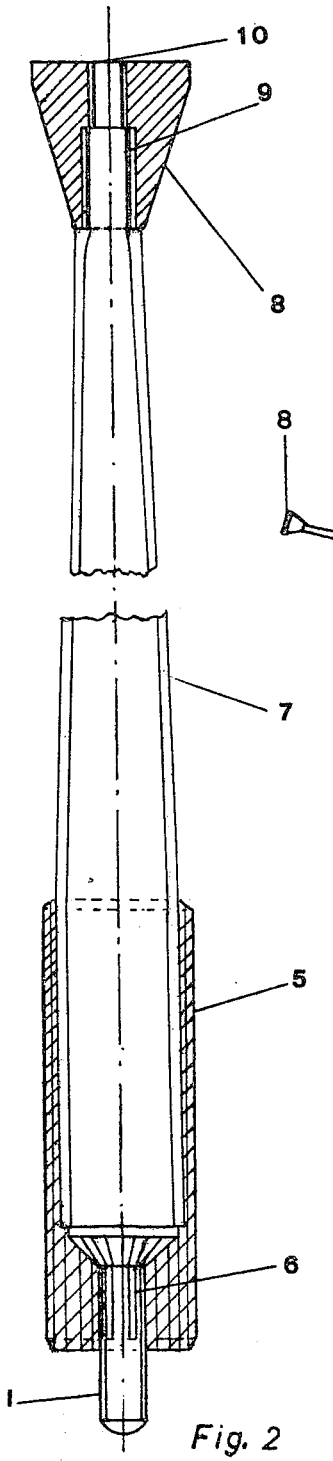
FIG. 2 shows a longitudinal section of a mono-stabilizer.
Figure 1:
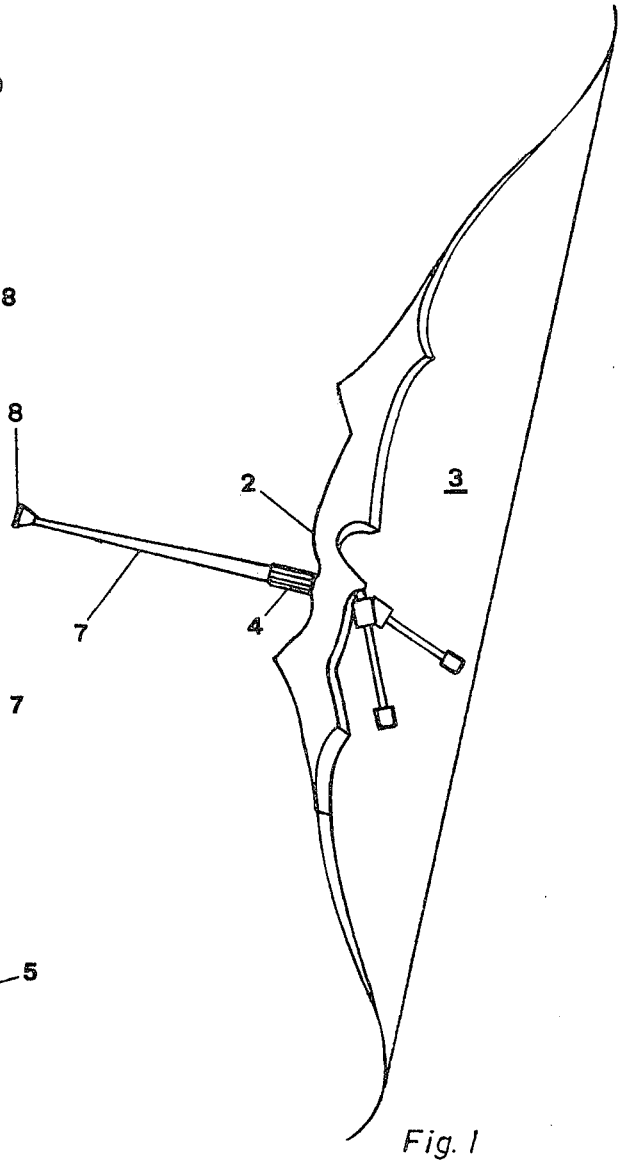
FIG. 1 shows a perspective view of the bow.

The mono-stabilizer is securely screwed with its screw bolt 1 into the stock 2 of the bow 3. The longitudinal grooves 4 in the sleeve part 5 facilitate a tight threading of the screw bolt by hand. The screw bolt 1 is press fitted to the sleeve 5 and presents a longitudinal fluting, which serves as a rotaton safety 6 relative to the sleeve 5. The sleeve 5 is pressed on the conical tube 7. The terminal part 8 has a self-cutting threading hole 9. The conical tube 7 must therefore be threaded initially at its tapered end into the threading hole 9 to the nominal diameter of the screw thread. The additional threading hole 10 serves for the fine setting of the damping effect by screwing on additional weights. Prior to this, the threading hole 10 may also be used as an auxiliary means for using a tool when screwing on the terminal part 8. This terminal part screwed on according to the present method results in a vibration-free connection with the tube 7, which is not loosened by the vibrations of the bow 3. Similarly the connections of the sleeve 5 with the tube 7, of the screw bolt 1 with the sleeve 5 and the stock 2 are vibration- and break-resistant against the bow oscillations.

The mono-stabilizer constructed in this way damps the oscillations of the bow immediately so that a quiet release of the arrow is assured.

What is claimed is:

1. A stabilizing device for an archery bow comprising:

(a) an elongated conical member;

(b) a sleeve having longitudinal grooves in the exterior surface thereof, said sleeve being pressed onto the proximal end of said elongated member over the outer surface thereof and forming a rigid connection therebetween with said grooves being exposed exteriorly of said elongated member;

(c) screw means, secured to said sleeve and including means for preventing rotation relative to said sleeve, for securing the proximal end of said elongated member to a bow and forming a substantially vibration-free connection therebetween;

(d) a terminal weight member having a self-cutting threaded portion whereby said terminal member is threadably connected to the distal end of said elongated member by relative rotation therebetween forming a substantially vibration-free connection;

(e) said elongated conical member tapering from wide to narrow in the direction of the proximal end to the distal end; and (f) said sleeve having a sufficient length and said grooves being so presented on the exterior surface thereof to facilitate tight threading of the screw means by hand whereby a vibration-free connection is formed between said elongated member and said bow by manually threading said screw means into a bow.

2. A stabilizing device as recited in claim 1, wherein said rotation-preventing means comprises longitudinal fluting on said screw means.

3. A stabilizing device as recited in claim 1, wherein said elongated member comprises a hollow tube.

4. A stabilzing device as recited in claim 3, wherein said tube is constructed of plastic.

5. A stabilizing device as recited in claim 3, wherein said tube is constructed of metal.

6. A stabilizing device as recited in claim 1, wherein said terminal weight member includes a second threading hole.

7. A stabilizing device as recited in claim 1, wherein said elongated member includes a starting thread, corresponding to said self-threading portion, at said second end.

* * * * *